US008079754B2

(12) United States Patent
Tsuchiya et al.

(10) Patent No.: US 8,079,754 B2
(45) **Date of Patent: *Dec. 20, 2011**

(54) WRISTWATCH GEAR AND METHOD FOR MANUFACTURING WRISTWATCH GEAR

(75) Inventors: Kazuhiro Tsuchiya, Nagano (JP); Satoru Masai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/942,290

(22) Filed: Nov. 9, 2010

(65) Prior Publication Data

US 2011/0051573 A1 Mar. 3, 2011

Related U.S. Application Data

(63) Continuation of application No. 12/355,254, filed on Jan. 16, 2009, now Pat. No. 7,854,546.

(30) Foreign Application Priority Data

Feb. 1, 2008 (JP) ..... 2008-022587

(51) Int. Cl.
*G04B 31/004* (2006.01)

(52) U.S. Cl. ..... 368/322; 368/323

(58) Field of Classification Search ..... 368/322, 368/323

See application file for complete search history.

(56) References Cited

U.S. PATENT DOCUMENTS

| | | | |
|---|---|---|---|
| 4,186,245 | A | 1/1980 | Gilman |
| 4,202,089 | A | 5/1980 | Ljung |
| 4,813,292 | A | 3/1989 | Boyko |
| 2007/0034304 | A1 | 2/2007 | Inoue et al. |

FOREIGN PATENT DOCUMENTS

| | | | |
|---|---|---|---|
| JP | 2002-323114 | A | 11/2002 |
| JP | 2005-325984 | A | 11/2005 |
| JP | 2007-040517 | A | 2/2007 |
| JP | 2007-040518 | A | 2/2007 |
| JP | 2008-6447 | A | 1/2008 |
| WO | WO-2005/024274 | A1 | 3/2005 |

*Primary Examiner* — Renee S Luebke
*Assistant Examiner* — Jason Collins
(74) *Attorney, Agent, or Firm* — Global IP Counselors, LLP

(57) ABSTRACT

The center wheel and pinion has a center shaft provided with a center pinion that is formed from a crystalline metal, and a center tooth part composed of a metallic glass alloy that is integrally formed with the center shaft. The center shaft has a center pinion and other external peripheral regions that are formed by cutting the external periphery of a cylindrical member provided with a support hole. The external periphery of the coupling part to which the center tooth part is coupled is formed in a quadrangular shape. The center tooth part composed of a metallic glass alloy has a tooth continuously formed at the disc-shaped external periphery, and a center position that is integrally formed surrounding the entire external periphery of the quadrangular-shaped coupling part of the center shaft.

7 Claims, 8 Drawing Sheets

WRISTWATCH GEAR AND METHOD FOR MANUFACTURING WRISTWATCH GEAR

CROSS-REFERENCE TO RELATED APPLICATIONS

This is a continuation application of U.S. patent application Ser. No. 12/355,254 which claims priority to Japanese Patent Application No. 2008-022587 filed on Feb. 1, 2008. The entire disclosure of U.S. patent application Ser. No. 12/355,254 and Japanese Patent Application No. 2008-022587 is hereby incorporated herein by reference.

BACKGROUND

1. Technological Field

The present invention relates to a small timepiece gear and a method for manufacturing the timepiece gear.

2. Background Technology

The device disclosed in Patent Document 1 is a known example of an electronically controlled mechanical timepiece provided with a train wheel mechanism.

The train wheel mechanism of Patent Document 1 has a barrel wheel for housing a mainspring in order to store mechanical energy, and the gears of second (central) to sixth wheels and pinions that serially mesh in order to transmit the mechanical energy of the mainspring to a rotor of a power generator. The rotation of the barrel wheel is transmitted to a center wheel and pinion, the rotation of the center wheel and pinion is increased and transmitted to the third wheel and pinion. The rotation of the third wheel and pinion is further increased and transmitted from the fourth wheel and pinion to the rotor via the sixth wheel and pinion.

The second (central) to sixth wheels and pinions are composed of components having a pinion and shaft member that are rotating shafts, being mutually coaxially formed, and a tooth part having a larger diameter than the pinion and being integrally formed on the external periphery of the shaft member. For example, the pinion and shaft member are formed by grinding using a lathe or the like, and the tooth part is formed in the shape of a disc by grinding or by using a punch press or the like while a securing hole is provided in a center position of a plate-shaped member. Each wheel is formed by cutting out the pinion and the tooth of the tooth part by gear milling and thereafter passing the shaft member through the securing hole and securing the shaft member.

In the train wheel mechanism, the greatest meshing stress, in comparison with the portion that meshes with another wheel, acts on the center tooth part of the center wheel and pinion for increasing and transmitting the rotation of the barrel wheel and on the portion that meshes with the third pinion of the third wheel and pinion.

Accordingly, in Patent Document 1, the center wheel and pinion and the third wheel and pinion are formed using a crystalline metal as a material having high-hardness properties (anti-abrasion properties), or the high-hardness central wheel and pinion and third wheel and pinion are formed by subjecting the matrix material of the crystalline metal to a hardening treatment in order to increase the durability and reliability of a timepiece.

[Patent Document 1] Japanese Laid-open Patent Application No. 2002-323114 (FIGS. 1 to 4)

SUMMARY

However, regions that require high-hardness properties are the center tooth part of the center wheel and pinion and the third pinion of the third wheel and pinion, and there is a problem in terms of the cost of manufacturing a gear when the entire central wheel and pinion and third wheel and pinion are formed from crystalline metal having high hardness, or when the entire central wheel and pinion and third wheel and pinion are subjected to a hardening treatment.

There is also a problem in that cutting and gear milling require a considerable amount of time and manufacturing efficiency is reduced when the central wheel and pinion and third wheel and pinion are formed using a high-hardness crystalline metal as a material.

The present invention was contrived in view of the unresolved issues of the above-described prior art example, and an object is to provide a timepiece gear and method for manufacturing a timepiece gear that can reduce manufacturing costs and improve manufacturing efficiency by endowing only the regions where stress is increased by meshing with anti-abrasion properties.

There are cases in which an alloy in a random non-crystalline state prior to crystal formation is formed when a starting material having a specific metal material as a primary component and in which a material including an element that satisfies predetermined conditions is very rapidly cooled from molten state. Such an alloy has the properties of glass in a predetermined temperature range and is therefore referred to as a "metallic glass alloy." The metallic glass alloy has high strength, a low Young's modulus, and high corrosion resistance, and is therefore advantageous as a material constituting various mechanical components such as gears.

In order to achieve the above-described objects, the timepiece gear of the first aspect of the present invention comprises a pinion and shaft integrally formed coaxially with each other, and a tooth part having a larger diameter than the pinion and being integrally formed on the external periphery of the shaft, the timepiece gear characterized in that a region to which stress is applied by meshing with another gear is formed from a metallic glass alloy, and other regions are formed from a crystalline metal.

A timepiece gear can thereby be manufactured at low cost in comparison with a conventional structure in which a high-hardness crystalline metal is used or the crystalline metal matrix is subjected to a hardening treatment in order to increase the abrasion resistance of the entire gear, because abrasion resistance is increased only in regions where stress due to meshing is increased.

In the timepiece gear of the second aspect of the present invention, the tooth part is formed from the metallic glass alloy, and the pinion and the shaft are formed from the crystalline metal.

The abrasion resistance of the tooth part of the timepiece gear can thereby be improved.

In the timepiece gear of the third aspect of the present invention, the external periphery provided with a tooth of the tooth part is formed from the metallic glass alloy, and the internal periphery of the tooth part, the pinion, and the shaft part are formed from the crystalline metal.

The abrasion resistance of the tooth part of the timepiece gear can thereby be increased and the timepiece gear can be manufactured at an even lower cost because and the internal periphery of the tooth part is formed from a crystalline metal.

In the timepiece gear of the fourth aspect of the present invention, the pinion and the shaft are formed from the metallic glass alloy, and the tooth part is formed from the crystalline metal.

The abrasion resistance of the pinion and shaft of the timepiece gear can thereby be increased.

In the timepiece gear of the fifth aspect of the present invention, a portion of the shaft is formed from the metallic glass alloy, and the pinion, the tooth part, and other portions of the shaft are formed from the crystalline metal.

The abrasion resistance of a portion of the shaft of the timepiece gear, e.g., a region that makes contact with the bearing can thereby be improved.

In the timepiece gear of the sixth aspect of the present invention, a coupling hole is formed in the axial center of the tooth part; a coupling part for fitting into and coupling with the coupling hole, is formed on the external periphery of the shaft; and the entire internal peripheral surface and external peripheral surface of the coupling hole and the coupling part, having the same polygonal shape or oval shape, are in contact with each other.

The adhering strength of the tooth part and shaft can thereby be increased with respect to high torque that acts on the timepiece gear from the exterior.

The invention the seventh aspect of the present invention is the timepiece gear according to any of the first to sixth aspects, wherein the metallic glass alloy is a metallic glass alloy whose composition has a Zr base, a Co base, a Fe base, or a Ni base.

The abrasion resistance of only the region in which stress is increased by meshing is thereby enhanced, and the durability of the gear can be increased because the metallic glass alloy composed of a Zr base, a Co base, a Fe base, and a Ni base has high strength, high toughness, and other excellent mechanical properties.

The eighth aspect of the present invention is a method for manufacturing the timepiece gear according to any of the first to seventh aspects, wherein a predetermined region of a gear formed from crystalline metal is disposed inside a molding die; introducing molten metal comprising the metallic glass alloy into a cavity provided in the molding die; and a molded article, formed from the metallic glass alloy by cooling and solidifying the molten metal in the cavity, is integrated with a predetermined region of the gear formed from crystalline metal as the remaining region of the gear.

A gear made of a composite metal composed of a crystalline metal and a metallic glass alloy can thereby be manufactured in a simple manner.

The ninth aspect of the present invention is the method for manufacturing a timepiece gear according to the eighth aspect, wherein the crystalline metal is a material having high thermoelectric conductivity.

The region composed of a high quality metallic glass alloy can thereby be formed because the molten metal filled into the cavity makes contact with the crystalline metal having high thermoelectric conductivity and the cooling speed is increased.

The tenth aspect of the present invention is the method for manufacturing a timepiece gear according to the eighth or ninth aspect, comprising: providing the molding die with a first die and a second die capable of opening and closing relative to each other, a cavity provided between the two dies when the first and second dies are closed, and a gate for supplying the molten metal inside the cavity, the gate being formed inside the second die; and setting the aperture surface area of that opens into the cavity of gate to a value of 7,500 to 75,000 $\mu m^2$, setting the adhering strength between the first die and the molded article to be greater than the adhering strength between the second die and the molded article, causing the molded article to adhere to the first die in a state in which the first and second dies are opened after the molded article has been molded, and breaking the molded article in the gate and separating the article from the second die.

Unnecessary parts can thereby be reliably removed in a simple manner from the region of the metallic glass alloy thus molded.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments (hereinafter referred to as embodiments) for implementing the present invention are described in detail below with reference to the drawings.

Figure 1:
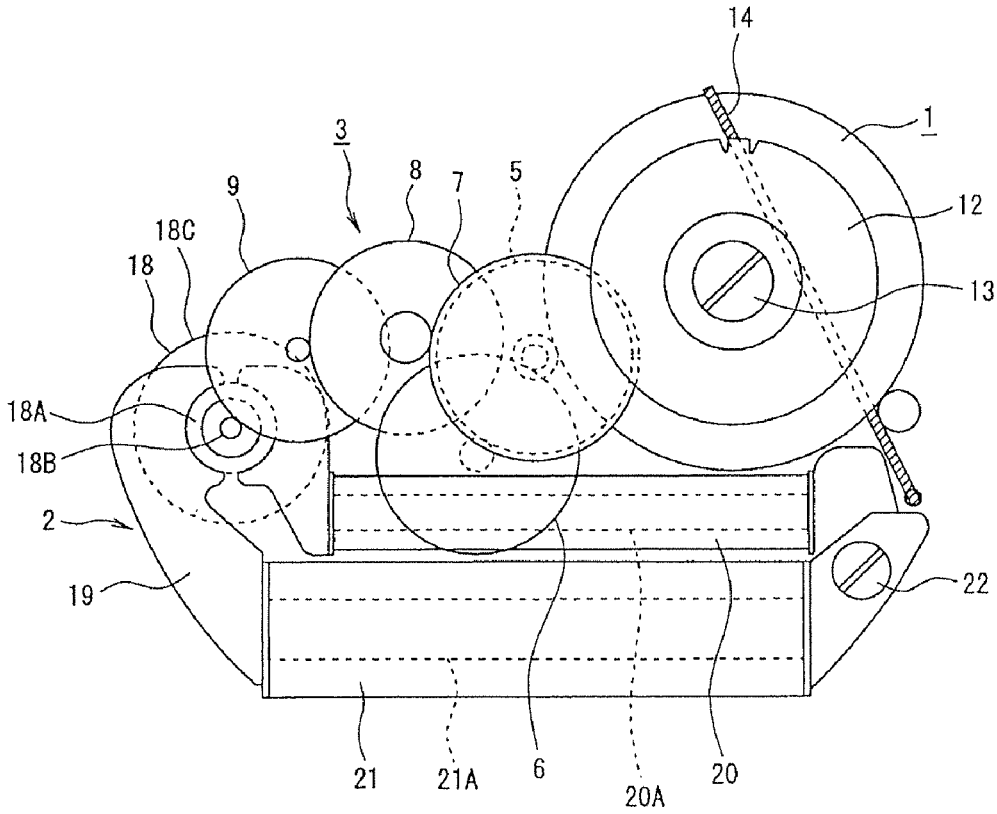
FIG. 1 is a plan view showing the train wheel mechanism of an embodiment of the electronically controlled mechanical timepiece according to the present invention.
Figure 2:
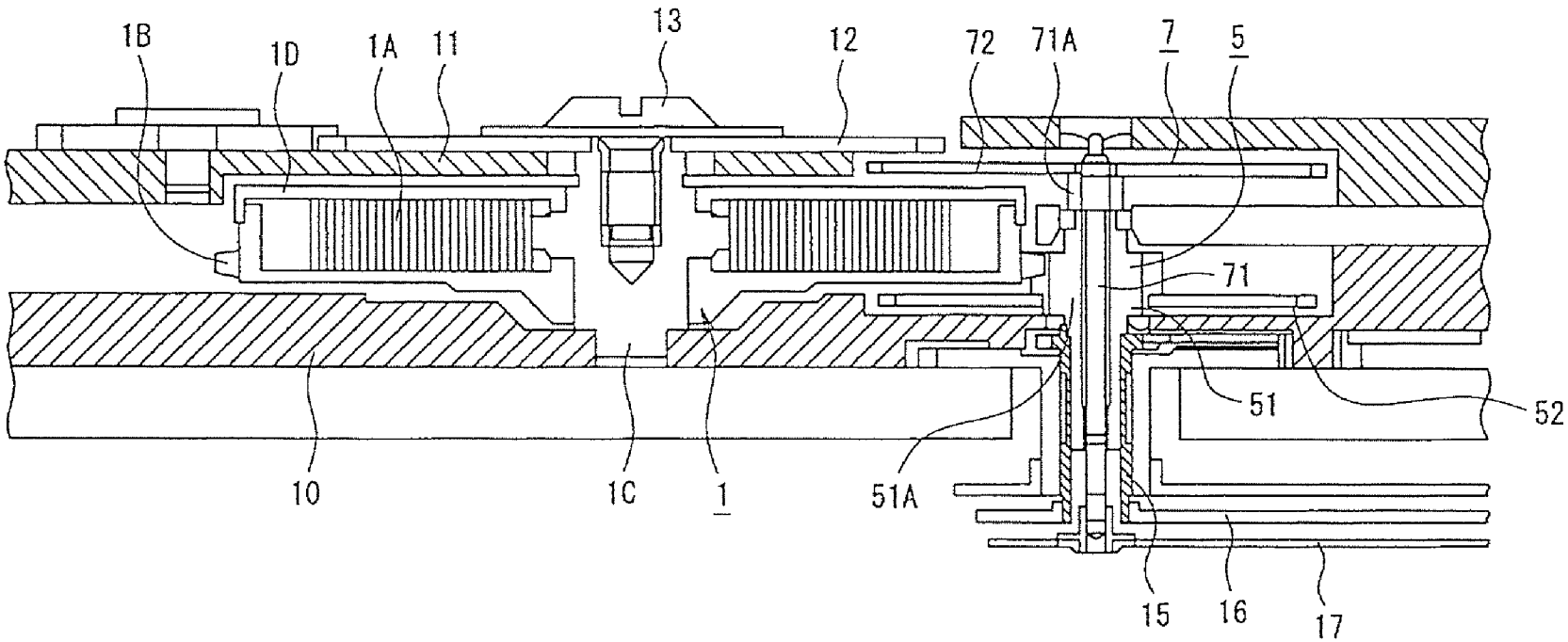
FIG. 2 is a diagram showing a cross section of the main part of the train wheel mechanism.
Figure 3:
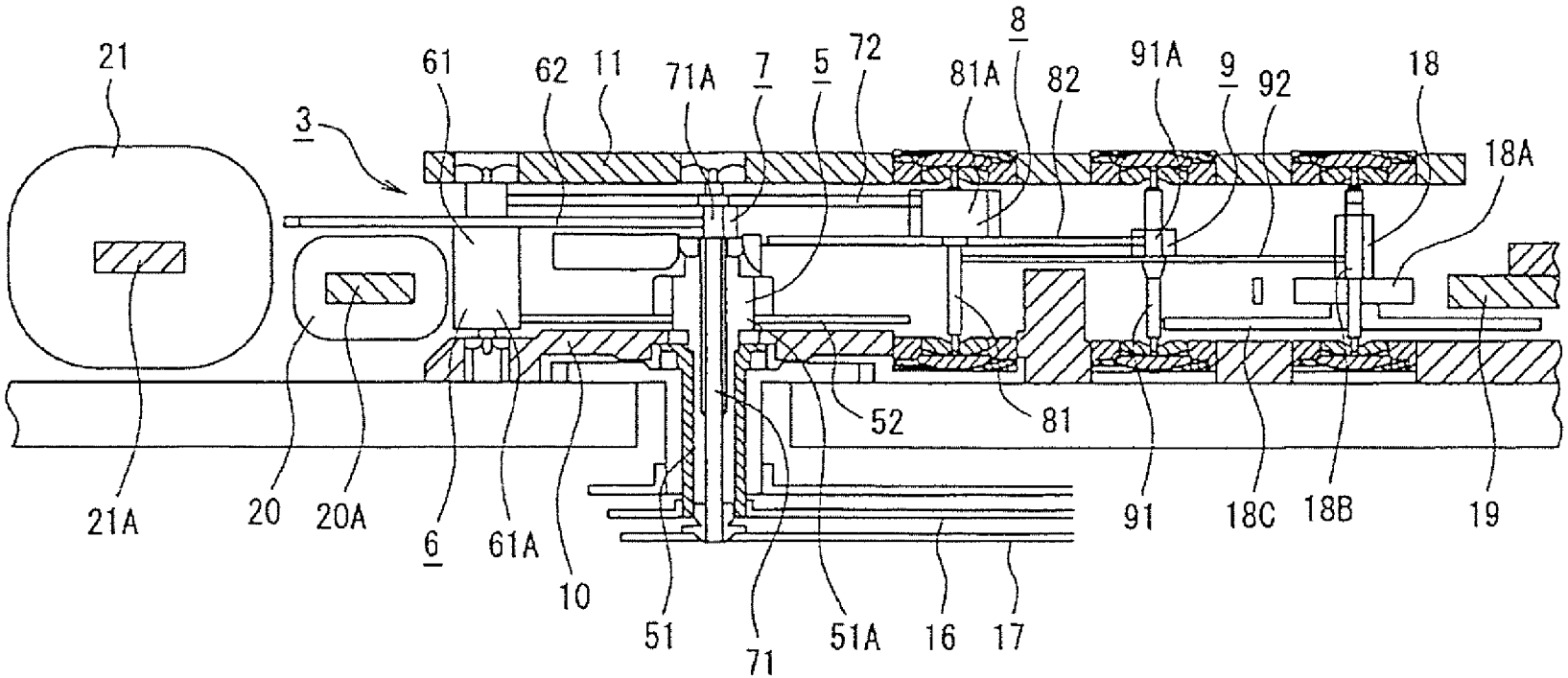
FIG. 3 is a diagram showing a cross section of the main part of the train wheel mechanism in a different direction from FIG. 2.

FIG. 1 is a plan view showing the train wheel mechanism of an embodiment of the electronically controlled mechanical timepiece according to the present invention, and FIGS. 2 and 3 are diagrams showing a cross section of the main part of the train wheel mechanism.

The electronically controlled mechanical timepiece according to the present invention is provided with a train wheel mechanism 3 for transmitting mechanical energy of a mainspring 1A to a power generator 2.

The train wheel mechanism 3 is composed of a barrel wheel 1, a center wheel and pinion 5, a third wheel and pinion 6, a fourth wheel and pinion 7, a fifth wheel and pinion 8, and a sixth wheel and pinion 9.

The barrel wheel 1 is composed of a barrel gear 1B rotatably driven by the mainspring 1A in which mechanical energy is stored, a barrel stem 1C for winding the mainspring 1A, and a barrel cover 1D, as shown in FIG. 2. The mainspring 1A has an external end secured to the barrel gear 1B and an internal end secured to the barrel stem 1C. The barrel stem 1C is rotatably supported between a train wheel bridge 11 and a main plate 10 disposed facing each other. A ratchet wheel 12 is secured to the barrel stem 1C by a ratchet screw 13, and the barrel stem 1C and the ratchet wheel 12 are configured so as to rotate integrally with each other. The mainspring 1A can be wound by the barrel stem 1C by rotating the ratchet wheel 12 in the clockwise direction with the aid of a crown (not shown). The ratchet wheel 12 meshes with a click 14 so as to allow rotation in the clockwise direction and to prevent rotation in the counterclockwise direction.

The rotation of the barrel gear 1B rotatably driven by the mainspring 1A is transmitted to the center wheel and pinion 5, is then increased and transmitted to the third wheel and pinion 6, and is sequentially further increased and transmitted to the fourth wheel and pinion 7, the fifth wheel and pinion 8, the sixth wheel and pinion 9, and a later-described rotor 18 of the power generator 2. In this configuration, a minute hand 16 is secured to the center wheel and pinion 5 via a cannon pinion 15, and a seconds hand 17 is secured to the fourth wheel and pinion 7. The power generator 2 is provided with the rotor 18, a stator 19, a first coil block 20, and a second coil block 21. The rotor 18 has a rotor pinion 18B, a rotor inertia disc 18C, and a rotor magnet 18A passed through the rotating shaft of the rotor. Among these, the rotor inertia disc 18C is provided for reducing fluctuations in the rotational speed of the rotor 18 in relation to the fluctuations in the drive torque from the barrel wheel 1.

The stator 19 forms a magnetic circuit of the power generator 2 together with the rotor magnet 18A of the rotor 18. The stator 19 is provided with magnetic cores 20A, 21A around which the first and second coil blocks 20, 21, respectively, are wound. The magnetic cores 20A, 21A are made of PC Permalloy or another soft magnetic material having high permeability and are connected to each other using a screw 22. When the rotor magnet 18A rotates, an induced voltage is thereby generated in the two ends of the first and second coil blocks 20, 21 in accordance with the rotation of the rotor magnet 18A, and electrical energy is obtained from the power generator 2. The power generator 2 having such a configuration doubles as a speed governor for governing the rotational speed of the rotor 18 in addition to converting the mechanical energy from the mainspring 1A into electrical energy, and adjusts the rotational speed of the rotor 18 using electrical energy generated by the power generator 2.

The center wheel and pinion 5, third wheel and pinion 6, fourth wheel and pinion 7, fifth wheel and pinion 8, and sixth wheel and pinion 9 have substantially the same configuration, are used as rotating shafts, and are composed of a center shaft 51, a third shaft 61, a fourth shaft 71, a fifth shaft 81, and a sixth shaft 91 that are integrally formed with a center pinion (cannon pinion) 51A, a third pinion 61A, a fourth pinion 71A, a fifth pinion 81A, and a sixth pinion 91A, respectively, as well as a disc-shaped center tooth part 52, a third tooth part 62, a fourth tooth part 72, a fifth tooth part 82, and a sixth tooth part 92 that are integrally formed with the shafts 51 to 91 and have a larger diameter than the pinions 51A to 91A.

The center pinion 51A of the center wheel and pinion 5 meshes with the barrel gear 1B of the barrel wheel 1. The third pinion 61A of the third wheel and pinion 6 meshes with the center tooth part 52 of the center wheel and pinion 5. The fourth pinion 71A of the fourth wheel and pinion 7 meshes with the third tooth part 62 of the third wheel and pinion 6. The fifth pinion 81A of the fifth wheel and pinion 8 meshes with the fourth tooth part 72 of the fourth wheel and pinion 7. The sixth pinion 91A of the sixth wheel and pinion 9 meshes with the fifth tooth part 82 of the fifth wheel and pinion 8. The rotor pinion 18B of the rotor 18 meshes with the sixth tooth part 92 of the sixth wheel and pinion 9.

Figure 4:
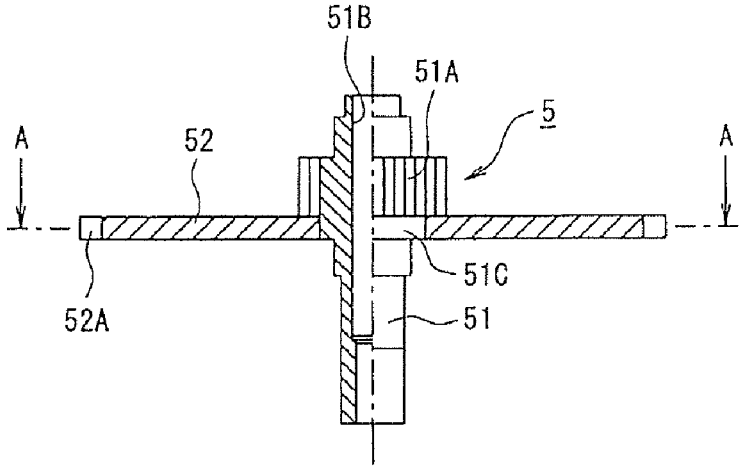
FIG. 4 is a diagram showing the configuration of the center wheel and pillion constituting the train wheel mechanism.
Figure 5:
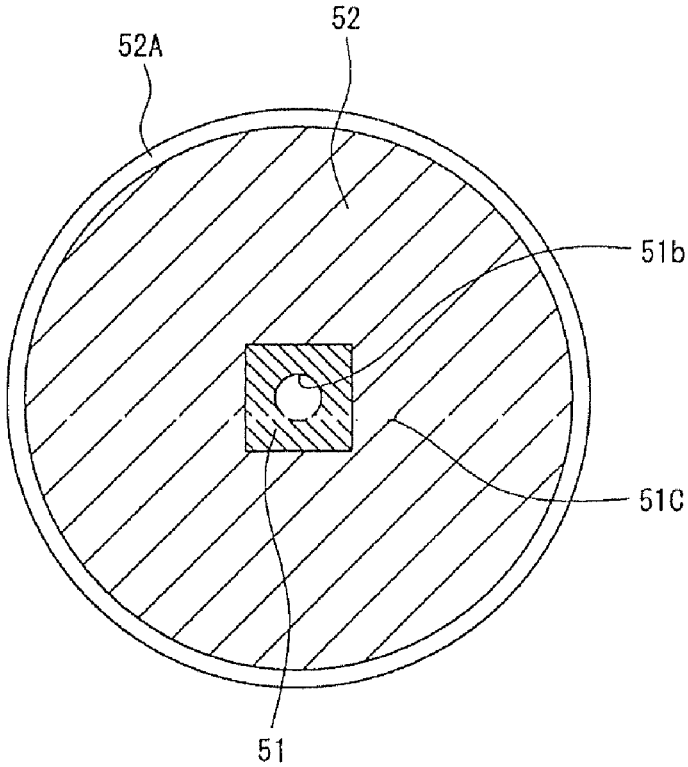
FIG. 5 is a view along the line A-A of FIG. 4.

Next, FIGS. 4 and 5 are diagrams showing the structure of the center wheel and pinion 5 in detail. The center shaft 51 of the center wheel and pinion 5 that is provided with the center pinion 51A is formed from a crystalline metal, and the center tooth part 52 composed of a metallic glass alloy is integrally formed with the center shaft 51. The crystalline metal has a grain boundary, which the boundary between crystal grains, and a dislocation or another discontinuous region, which is positional displacement on the atomic level inside the crystal grains. In contrast, the metallic glass alloy has a random atomic arrangement and is a metal material in which a grain boundary, a dislocation, or another discontinuous region is essentially not present. Specifically, in the present embodiment, the metallic glass alloy is used whose composition has a Zr base, a Co base, a Fe base, a Ni base, or the like, which have excellent anti-abrasion properties.

The center pinion 51A and the other external peripheral regions of the center shaft 51 composed of a crystalline metal are formed by cutting the external periphery of a cylindrical member provided with a support hole 51B, and the external periphery of a coupling part 51C for coupling with the center tooth part 52 is formed in a quadrangular shape, as shown in FIG. 5. The support hole 51B rotatably supports a fourth shaft 71 excluding the fourth pinion 71A of the fourth wheel and pinion 7.

The center tooth part 52 composed of a metallic glass alloy has a tooth 52A continuously formed on the disc-shaped external periphery, as shown in FIG. 5, and has a center position that is integrally formed surrounding the entire external periphery of the quadrangular coupling part 51C of the center shaft 51.

Therefore, in accordance with the center wheel and pinion 5 having the configuration described above, the hardness of the center tooth part 52 composed of a crystalline metal having, e.g., a Zr-based, Co-based, Fe-based, or Ni-based composition is Hv=about 1,000, which is very high in comparison with a crystalline metal (Hv=700) composed of steel. Therefore, it is possible to improve the abrasion resistance of the center tooth part 52 in meshing with the third pinion 61A of the third wheel and pinion 6.

The durability of the center tooth part 52 can be increased because the metallic glass alloy whose composition has a Zr base, Co base, Fe base, Ni base, or the like is endowed with high strength, high toughness, and other excellent mechanical properties.

The external periphery of the coupling part 51C of the center shaft 51 is formed in the shape of a quadrangle and the center tooth part 52 is integrally formed on the external periphery of the coupling part 51C and surrounds the entire external periphery of the coupling part 51C. Therefore, the adhering force of the center shaft 51 and the center tooth part 52 can be increased with respect to high torque that operates from the exterior.

The center wheel and pinion 5 can be manufactured at low cost because a configuration is used in which the abrasion resistance of only the region (center tooth part 52) in which considerable meshing stress operates is increased, rather than a structure in which the abrasion resistance of the entire center wheel and pinion 5 is increased.

The external periphery of the coupling part 51C of the center shaft 51 is not limited to a quadrangular shape, and a polygonal shape and a noncircular oval shape may also be used.

Figure 6:
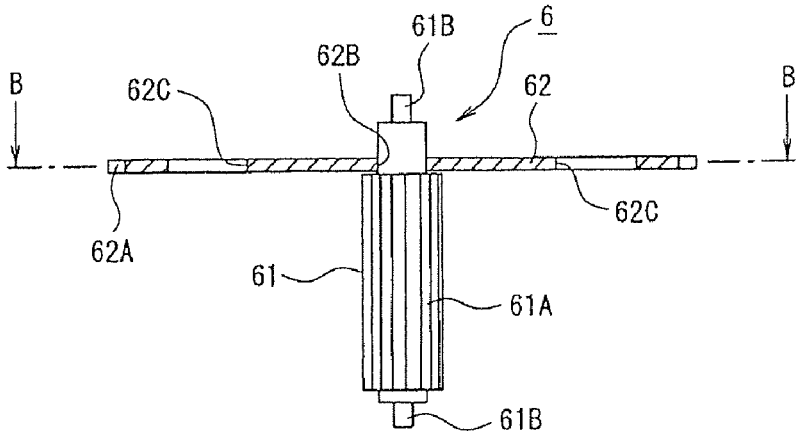
FIG. 6 is a diagram showing the configuration of the third wheel and pinion constituting the train wheel mechanism.
Figure 7:
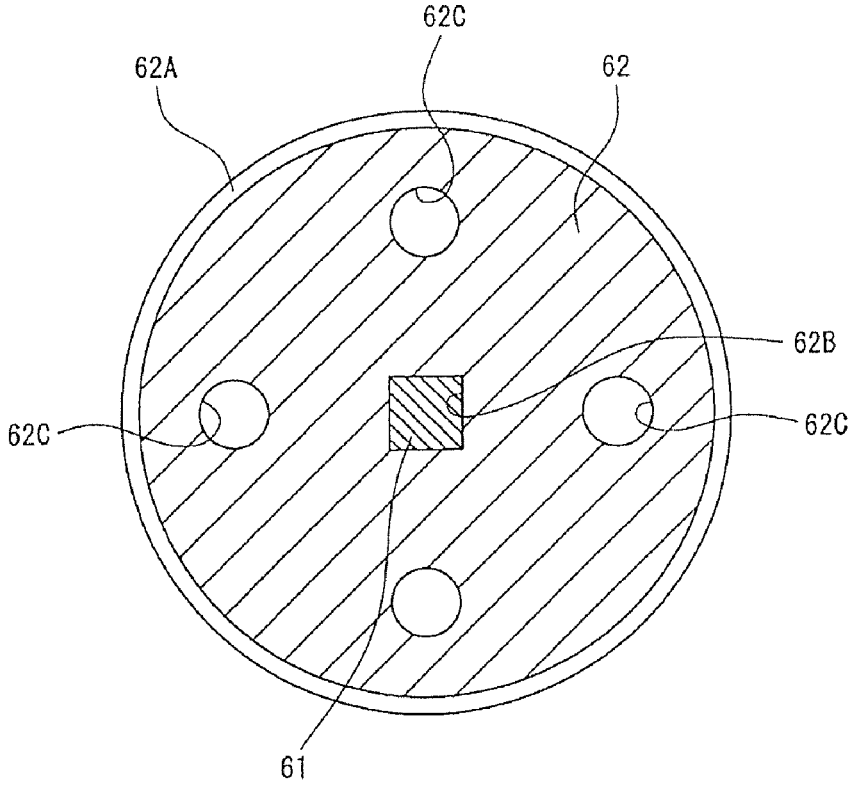
FIG. 7 is a view along the line B-B of FIG. 6.

FIGS. 6 and 7 are diagrams showing a detailed structure of the third wheel and pinion 6. The third wheel and pinion 6 has a third shaft 61 provided with a third pinion 61A that is formed from a metallic glass alloy, and a third tooth part 62 composed of a crystalline metal integrally formed with the third shaft 61.

The third tooth part 62 composed of a crystalline metal has a tooth 62A continuously formed on the disc-shaped external periphery, as shown in FIG. 7, and a quadrangular coupling hole 52B formed in a center position. The reference numeral 62C is a continuous hole that passes through the front and back of the third tooth part 62.

The third shaft 61 composed of a metallic glass alloy is one in which a metallic glass alloy composed of a Zr base, Co base, Fe base, Ni base, or the like is used as a material in the same manner as the center tooth part 52 of the center wheel and pinion 5 described above.

The third shaft 61 has a shaft 61B formed at the two ends of the third pinion 61A and is surrounded by and integrally formed with the entire internal periphery of the quadrangular coupling hole 62B of the third tooth part 62.

Therefore, in accordance with the third wheel and pinion 6 having the configuration described above, the hardness of the third shaft 61 composed of a metallic glass alloy having, e.g., a Zr-based, Co-based, Fe-based, or Ni-based, composition is Hv=about 1,000, which is very high in comparison with a crystalline metal (Hv=700) composed of steel. Therefore, it is possible to improve the abrasion resistance of the third pinion 61A in meshing engagement with the center tooth part 52 of the center wheel and pinion 5.

The durability of the third pinion 61A can be increased because the metallic glass alloy composed of a Zr base, Co base, Fe base, Ni base, or the like has high strength, high toughness, and other excellent mechanical properties.

The coupling hole 62B of the third tooth part 62 is formed in a quadrangular shape and is integrally formed with the third shaft 61, which is surrounded by the entire internal periphery of the coupling hole 62B. Therefore, the adhering strength of the third shaft 61 and the third tooth part 62 can thereby be increased with respect to high torque that acts from the exterior.

The third wheel and pinion 6 can be manufactured at low cost because a configuration is used in which the abrasion resistance of only the region (third pinion 61A) in which considerable meshing stress operates is increased, rather than a structure in which the abrasion resistance of the entire third wheel and pinion 6 is increased.

The internal periphery of the coupling hole 62B of the third tooth part 62 is not limited to a quadrangular shape, and a polygonal shape and an oval shape excluding a circular shape may be used.

Here, in the timepiece provided with the train wheel mechanism 3 shown in FIGS. 1 to 3, the greatest meshing stress in comparison with the meshing portions of other gears operates on the meshing portion of the center tooth part 52 of the center wheel and pinion 5 and the third pinion 61A of the third wheel and pinion 6 that increase and transmit the speed of the rotation of the barrel wheel 1.

In contrast, in the present embodiment, the durability and reliability of the timepiece can be improved because the center tooth part 52 of the center wheel and pinion 5 and the third pinion 61A of the third wheel and pinion 6 are formed from a metallic glass alloy composed of a Zr base, Co base, Fe base, Ni base, or the like as described above, the amount of abrasion generated between the center tooth part 52 and the third pinion 61A that mesh with each other is reduced, and the abrasion resistance of the train wheel mechanism 3 is improved.

The durability and reliability of the timepiece of the present embodiment can be further improved because the metallic glass alloy composed of a Zr base, Co base, Fe base, Ni base, or the like has high strength, high durability, and other excellent mechanical properties.

The cost of manufacturing a timepiece can be reduced because the abrasion resistance of only the regions (center tooth part 52 and third pinion 61A) in which the considerable meshing stress of the center wheel and pinion 5 and the third wheel and pinion 6 operates is increased, and the cost of the center wheel and pinion 5 and the third wheel and pinion 6 can be reduced.

Figure 8:
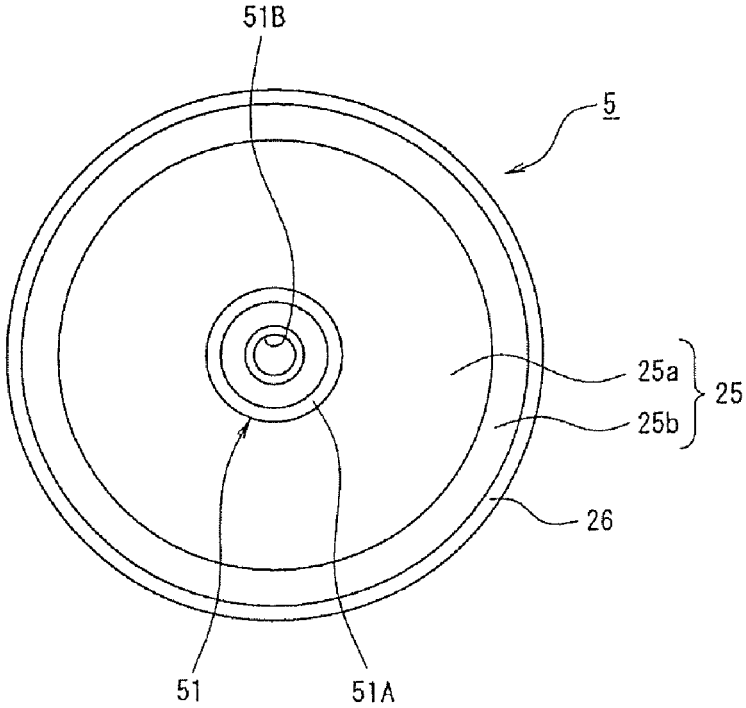
FIG. 8 is a diagram showing the center wheel and pinion having a different configuration from FIG. 4.

Next, FIG. 8 shows a center wheel and pinion 5 having a different configuration from that shown in FIGS. 4 and 5. The same reference numerals are assigned to the same constituent elements as FIGS. 4 and 5, and a description thereof is omitted.

The center wheel and pinion 5 of the present embodiment is composed of an internal diameter tooth part 25*a* composed of a crystalline metal, and an external periphery tooth part 25*b* integrally formed in an annular state about the external periphery of the internal diameter tooth part 25*a* and composed of a metallic glass alloy in which a tooth 26 is continuously formed on the outermost periphery. [The internal diameter tooth part and the external periphery tooth part] constitute a center tooth part 25 integrally formed with the center shaft 51 composed of a crystalline metal.

The external periphery tooth part 25*b* is composed of a metallic glass alloy having, e.g., a Zr-based, Co-based, Fe-based, or Ni-based composition having excellent abrasion resistance in the same manner as the embodiment described above.

In accordance with the center wheel and pinion 5 of the present embodiment, the abrasion resistance of the center tooth part 25 in meshing with the third pinion 61A of the third wheel and pinion 6 because the hardness of the external periphery tooth part 25*b* composed of the metallic glass alloy having, e.g., a Zr-based, Co-based, Fe-based, or Ni-based composition is very high.

Material costs can be reduced because the center tooth part 25 is formed using a small amount of metallic glass alloy in comparison with the center wheel and pinion 5 shown in FIGS. 4 and 5.

Figure 9:
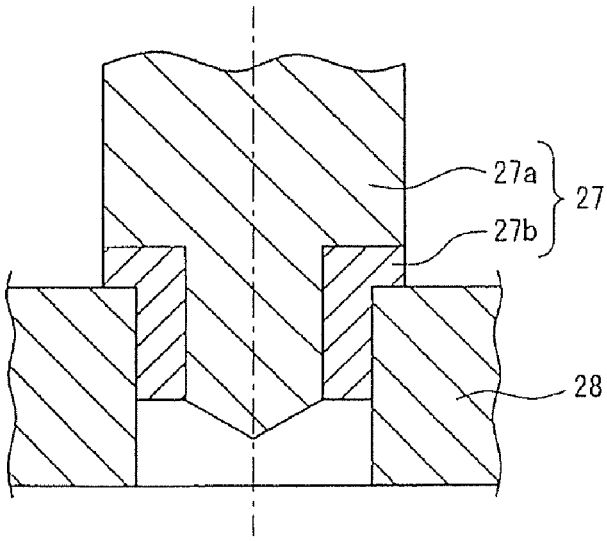
FIG. 9 is a diagram showing the structure of the bearing and the shaft of the gear of the train wheel mechanism.

FIG. 9 shows the bearing structure of any of the gears (predetermined gear) constituting the train wheel mechanism 3.

A shaft 27 of the gear of the present embodiment has a shaft main body 27*a* formed from a crystalline metal, as well as a cylindrical shaft reinforcement 27*b* composed of a metallic glass alloy integrally formed with the external periphery of the end part of the shaft main body 27*a*. The shaft reinforcement 27*b* makes contact with a bearing 28, whereby the end of the shaft 27 is rotatably supported by the bearing 28.

The shaft reinforcement 27*b* is formed from a metallic glass alloy having, e.g., a Zr-based, Co-based, Fe-based, or Ni-based composition in which the abrasion resistance is excellent, in the same manner as the embodiment described above.

In accordance with the present embodiment, the hardness of the shaft reinforcement 27*b* composed of a metallic glass alloy having, e.g., a Zr-based, Co-based, Fe-based, or Ni-based composition is very high. Therefore, the abrasion resistance of the shaft 27 can be improved.

The timepiece gear according to the present invention is not limited to the embodiment shown FIGS. 4 to 9 and is characterized in that the abrasion resistance is improved by using a metallic glass alloy to form regions to which stress is applied by gear meshing. In FIGS. 6 and 7, for example, the entire third shaft 61 is formed from a metallic glass alloy, but the third pinion 61A may be formed from a metallic glass alloy and the third shaft 61 excluding the third pinion 61A may be formed from a crystalline metal.

Next, the method for manufacturing the center wheel and pinion 5 shown in FIGS. 4 and 5 will be described with reference to FIGS. 10 and 11.

Figure 10:
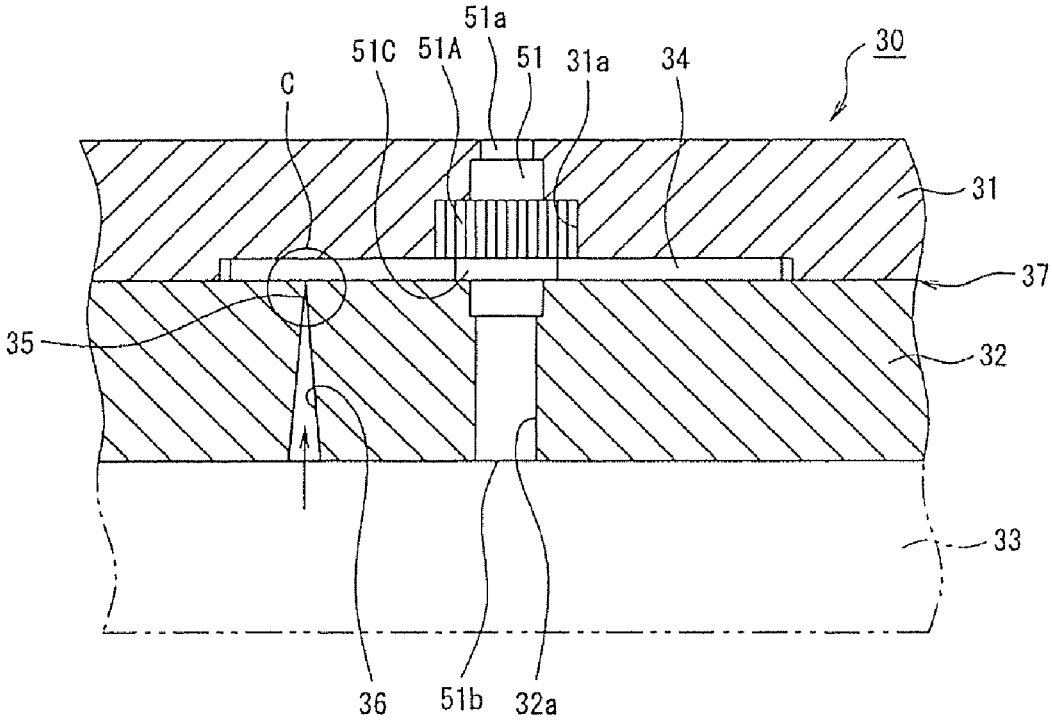
FIG. 10 is a diagram showing the method for manufacturing the center wheel and pinion constituting the train wheel mechanism.
Figure 11:
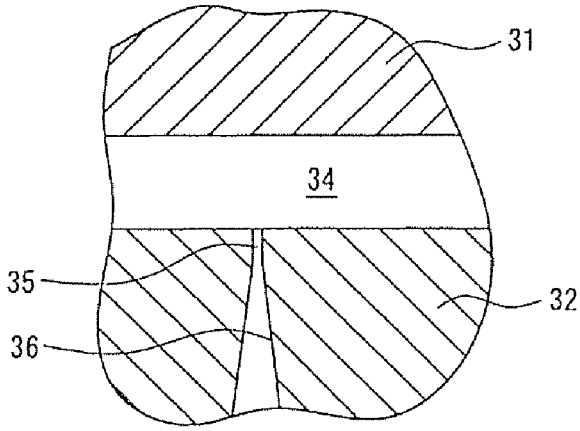
FIG. 11 is an enlarged view of the region indicated by the reference symbol C of FIG. 10.

The center wheel and pinion 5 is insert molded by using a molding die 30 having a first plate 31, a second plate 32, and a third plate 33 that are openably/closeably provided relative to each other, and by filling a molten material composed of a metallic glass alloy into the molding die 30 in which the center shaft 51 composed of a crystalline metal is disposed, as shown in FIG. 10.

The center shaft 51 is formed from brass having high thermoelectric conductivity, a Cu-containing crystalline metal, steel, or another crystalline metal. The external peripheral surface of the quadrangular coupling part 51C of the center shaft 51 is subjected to electric-discharge finishing, blasting, cutting, rough finishing, and the like to form a rough surface.

The first to third plates 31 to 33 are formed from, e.g., heat-resistant steel or a super-hard alloy, and a shaft accommodation concavity 31*a* that surrounds the external periphery of one of the end parts 51*a*, including the center pinion 51A of the center shaft 51, is formed in the first plate 31. A shaft accommodation concavity 32*a* that surrounds the external periphery of the other end part 51*b* of the center shaft 51 excluding the coupling part 51C having a quadrangular external periphery is formed in the second plate 32.

Formed in the parting surface 37 between the first and second plates 31, 32 are a space that is the same as that of the center tooth part 52 that is to be formed and a cavity 34 that encompasses the external peripheral surface of the coupling part 51C of the center shaft 51. The inside wall surface of the first and second plates 31, 32 that forms the cavity 34 is set so that the surface area of the inside wall surface of the first plate 31 is greater than the surface area of the inside wall surface of the second plate 32.

Formed on the second plate 32 are a gate 35 formed along the vertical direction with the outlet opened from below with respect to the cavity 34, and a runner 36 that connects to the end opposite of the outlet of the gate 35 and that has a cross-sectional surface area that is greater than that of the gate 35. The internal peripheral surface of the gate 35 has a cylindrical shape, as shown in FIG. 11, and the cross-sectional surface area of the internal peripheral surface is formed to be a very small cross section of about 7,500 to 75,000 $\mu m^2$. The internal peripheral surface of the runner 36 is tapered, having a gradually narrowing diameter in progression toward the gate 35, and the angle of the release taper of the tapered internal peripheral surface is set to about 10 to 30°.

A sprue (not shown) that is in communication with the runner 36 is connected to the third plate 33, and a supply source (not shown) for supplying a molten metallic glass alloy is connected to the sprue.

Next, the procedure for manufacturing the center wheel and pinion 5 using the molding die 30 configured in the manner described above will be described.

First, the molding die 30 is closed in a state in which the center shaft 51 is disposed inside the shaft accommodation concavities 31*a*, 32*a*. The pressure inside the cavity 34 is reduced using decompression means (not shown).

Next, the metallic glass alloy composed of, e.g., a Zr-based, Co-based, Fe-based, or Ni-based composition is heated to a predetermined temperature to generate a molten metal, and the molten metal is injected into the cavity 34 from the supply source via the sprue, the runner 36, and the gate 35.

The molten metal injected into the cavity 34 is rapidly cooled by contact with the inside wall surface of the first and second plates 31, 32 that form the cavity 34 and by contact with the coupling part 51C of the center shaft 51 composed of a crystalline metal having high thermoelectric conductivity. The atoms randomly present in the molten metal solidify in a state in which the random arrangement is maintained. As a result, the molten metal inside the cavity 34 forms a metallic glass alloy in which the atoms are randomly arranged, and the external periphery has the same shape as the tooth 52A of the center tooth part 52 and forms the center tooth part 52 composed of a disc-shaped metallic glass alloy in which the center part is integrally formed with the external peripheral surface of the quadrangular coupling part 51C of the center shaft 51.

Next, the second plate 32 and the third plate 33 are moved downward in relation to the first plate 31. In this case, the center tooth part 52 formed inside the cavity 34 adheres to the first plate 31 when the parting surface 37 opens between the first plate 31 and the second plate 32 because the inside wall surfaces of the first and second plates 31, 32 that form the cavity 34 are set so that the surface area of the inside wall surface of the first plate 31 is greater than the inside wall surface of the second plate 32. When the second plate 32 moves downward, the metallic glass alloy present in the gate 35 breaks away from the metallic glass alloy present in the tapered runner 36 due to the effect of tensile stress, and the unnecessary part (the metallic glass alloy present in the gate 35) of the metallic glass alloy is removed from the center tooth part 52. A center wheel and pinion 5 is thereby manufactured in which the center shaft 51 composed of a crystalline metal and the center tooth part 52 composed of a metallic glass alloy are integrally formed.

Therefore, a center wheel and pinion 5 made of a composite metal composed of a crystalline metal and a metallic glass alloy can thereby be manufactured in a simple manner in accordance with the manufacturing method described above.

The center shaft 51 is formed from a crystalline metal having high thermoelectric conductivity, whereby a center tooth part 52 composed of a high-quality metallic glass alloy can be formed because the molten metal injected into the cavity 34 cools more rapidly in contact with the coupling part 51C of the center shaft 51.

The external peripheral surface of the quadrangular coupling part 51C of the center shaft 51 is subjected to electric-discharge finishing, blasting, cutting, rough finishing, and the like to form a rough surface. Therefore, the anchor effect with the center tooth part 52 composed of a metallic glass alloy integrally formed surrounding the entire external periphery of the coupling part 51C can be increased.

The cross section of the gate 35 formed in the second plate 32 is considerably reduced, and the inside wall surfaces of the first and second plates 31, 32 forming the cavity 34 are set so that the surface area of the inside wall surface of the first plate 31 is greater than the surface area of the inside wall surface of the second plate 32. Therefore, the unnecessary part (the metallic glass alloy present in the gate 35) can be easily and reliably removed from the center tooth part 52 by merely opening the die comprising the first and second plates 31, 32. The center wheel and pinion 5 can be manufactured with good efficiency by omitting processing for cutting away unnecessary parts and carrying out other finishing after manufacture, and manufacturing costs can be reduced.

Next, the method for manufacturing the third wheel and pinion 6 shown in FIGS. 6 and 7 will be described with reference to FIGS. 12 and 13.

Figure 12:
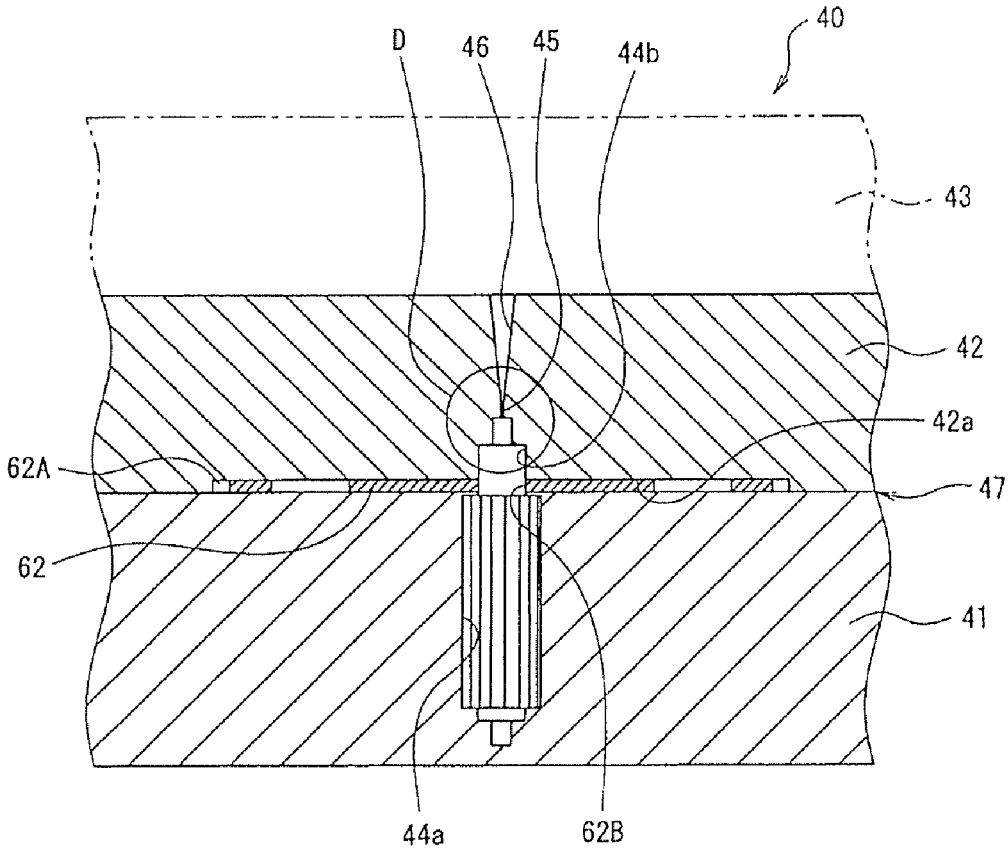
FIG. 12 is a diagram showing the method for manufacturing the third wheel and pinion constituting the train wheel mechanism.
Figure 13:
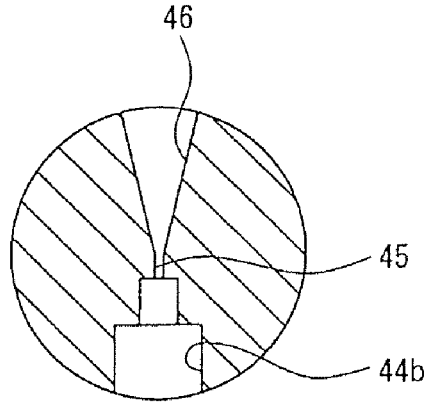
FIG. 13 is an enlarged view of the region indicated by the reference symbol D of FIG. 12

The third wheel and pinion 6 is insert molded by using a molding die 40 having a first plate 41, a second plate 42, and a third plate 43 that are openably/closeably provided relative to each other, and by filling a molten material composed of a metallic glass alloy into the molding die 40 in which the third tooth part 62 composed of a crystalline metal is disposed, as shown in FIG. 12.

The third tooth part 62 is formed from brass having high thermoelectric conductivity, a crystalline metal containing Cu, steel or another crystalline metal. The internal peripheral surface of the quadrangular coupling hole 62B provided in a center position of the third tooth part 62 is subjected to electric-discharge finishing, blasting, cutting, rough finishing, and the like to form a rough surface.

The first to third plates 41 to 43 are formed from, e.g., heat-resistant steel or a super-hard alloy, and a tooth part accommodation concavity 42*a* that surrounds the external periphery of the third tooth part 62 is formed in the parting surface 47 between the first and second plates 41, 42.

A first cavity 44*a* that forms a space having the same shape as the third pinion 61A of the third shaft 61 to be formed is formed in the first plate 41, and a second cavity 44*b* that forms a space having the same shape as the portions other than the third pinion 61A of the third shaft 61 is formed in the second plate 42. The first and second cavities 44*a*, 44*b* are formed so as to be in coaxial communication via the quadrangular coupling hole 62B of the third tooth part 62 disposed in the tooth part accommodation concavity 42*a*. Here, the surface area of the inside wall surface of the first plate 41 that forms the first cavity 44*a* is set so as to be greater than the surface area of the second plate 42 that forms the second cavity 44*b*.

Formed on the second plate 42 are a gate 45 formed along the vertical direction with the outlet opened from above with respect to the second cavity 44*b*, and a runner 46 that connects to the end opposite of the outlet of the gate 45 and has a cross-sectional surface area that is greater than that of the gate 45. The internal peripheral surface of the gate 45 is cylindrically shaped, as shown in FIG. 12, and the cross-sectional surface area of the internal peripheral surface is formed to have a cross section of about 7,500 to 75,000 $\mu m^2$. The internal peripheral surface of the runner 46 is tapered, having a gradually narrowing diameter in progression toward the gate 45, and the angle of the release taper of the tapered internal peripheral surface is set to about 10 to 30°.

A sprue (not shown) that is in communication with the runner 46 is connected to the third plate 43, and a supply source (not shown) for supplying a molten metallic glass alloy is connected to the sprue.

Next, the procedure for manufacturing the third wheel and pinion 6 using the molding die 40 configured in the manner described above will be described.

First, the third tooth part 62 is arranged inside the tooth part accommodation concavity 42*a*. The molding die 40 is set in a closed state and the pressure in the first and second cavities 44*a*, 44*b* is reduced using decompression means (not shown).

Next, the metallic glass alloy composed of, e.g., a Zr-based, Co-based, Fe-based, or Ni-based composition is heated to a predetermined temperature to generate a molten metal, and the molten metal is injected into the first and second cavities 44*a*, 44*b* from the supply source via the sprue, the runner 46, and the gate 45.

The molten metal injected into the first and second cavities 44*a*, 44*b* is rapidly cooled by contact with the inside wall surface of the first and second plates 41, 42 that form the first and second cavities 44*a*, 44*b* and by contact with the coupling hole 62B of the third tooth part 62 composed of a crystalline metal having high thermoelectric conductivity. The atoms randomly present in the molten metal solidify in a state in which the random arrangement is maintained. As a result, the molten metal inside the first and second cavities 44*a*, 44*b* and the coupling hole 62B of the third tooth part 62 forms a metallic glass alloy in which the atoms are randomly arranged, and forms the third shaft 61 composed of a metallic glass alloy in an integrally formed state with the coupling hole 62B of the third tooth part 62.

Next, the first plate 41 is moved downward in relation to the second plate 42. In this case, the upper part (portion other than the third pinion 61A) of the third shaft 61 molded inside the second cavity 44*b* is separated from the second plate 42 when the parting surface 47 between the first plate 41 and the second plate 42 is opened, because the surface area of the inside wall surface of the first cavity 44*a* formed in the first plate 41 is set to be greater than the surface area of the inside wall surface of the second cavity 44*b* formed in the second plate 42. When the first plate 41 moves downward, the metallic glass alloy present in the gate 45 breaks away from the metallic glass alloy present in the tapered runner 46 due to the effect of tensile stress, and the unnecessary part (the metallic glass alloy present in the gate 45) of the metallic glass alloy is removed from the third shaft 61. A third wheel and pinion 6 is thereby manufactured in which the third tooth part 62 composed of a crystalline metal and the third shaft 61 composed of a metallic glass alloy are integrally formed.

Therefore, a third wheel and pinion 6 made of a composite metal composed of a crystalline metal and a metallic glass alloy can thereby be manufactured in a simple manner in accordance with the manufacturing method described above.

The third tooth part 62 is formed from a crystalline metal having high thermoelectric conductivity, whereby a third shaft 61 composed of a high-quality metallic glass alloy can be formed because the molten metal injected into the first and second cavities 44*a*, 44*b* cools more rapidly when in contact with the coupling hole 62B of the third shaft 62.

The internal peripheral surface of the quadrangular coupling hole 62B provided in a center position of the third tooth part 62 is subjected to electric-discharge finishing, blasting, cutting, rough finishing, and the like to form a rough surface. Therefore, the anchor effect with the third shaft 61 composed of a metallic glass alloy integrally formed surrounding the entire internal periphery of the coupling hole 62B can be increased.

The cross section of the gate 45 formed in the second plate 42 is considerably reduced, and the surface area of the inside wall surface of the first cavity 44*a* formed in the first plate 41 is set so to be greater than the surface area of the inside wall surface of the second cavity 44*b* formed in the second plate 42. Therefore, the unnecessary part (the metallic glass alloy present in the gate 45) can be easily and reliably removed from the third shaft 61 by merely opening the die comprising the first and second plates 41, 42. Consequently, the third wheel and pinion 6 can be manufactured with good efficiency by omitting processing for cutting away unnecessary parts and carrying out other finishing after manufacture, and manufacturing costs can be reduced.

In the method for manufacturing the gears shown in FIGS. 10 to 13, a molding die provided with a first plate, a second plate, and a third plate was described, but the method for manufacturing a timepiece gear according to the present invention is not limited the molding die.

The manufacture of the center wheel and pinion 5 and the third wheel and pinion 6 is not limited to the insert molding described above, and the gear may be formed integrally forming a gear component composed of a crystalline metal and a gear component composed of a metallic glass alloy by friction stirring and joining, resistance welding, brazing, or another mechanical joining. In such a case, the adhering strength of the gear component composed of a crystalline metal and a gear component composed of a metallic glass alloy can be increased when the surfaces of the coupling part and coupling hole for coupling in a state in which the gear component composed of a crystalline metal and a gear component composed of a metallic glass alloy are mutually fitted together are formed as rough surfaces by electric-discharge finishing, blasting, cutting, rough finishing, and the like.

The application of the timepiece gear according to the present invention is not limited to a train wheel mechanism of an electronically controlled mechanical timepiece, and application can also be made to a train wheel mechanism of a mechanical clock or a quartz clock.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A timepiece provided with a timepiece gear the timepiece gear is comprising:

a pinion;

a shaft integrally and coaxially formed with the pinion; and a tooth part having a larger diameter than the pinion and being integrally formed on external periphery of the shaft, the timepiece gear having a region to which stress is applied by meshing with another gear is formed from a metallic glass alloy, and other regions are formed from a crystalline metal.

2. The timepiece according to claim 1, wherein the tooth part is formed from the metallic glass alloy, and the pinion and the shaft are formed from the crystalline metal.

3. The timepiece according to claim 1, wherein the external periphery provided with a tooth of the tooth part is formed from the metallic glass alloy, and the internal periphery of the tooth part, the pinion, and the shaft part are formed from the crystalline metal.

4. The timepiece according to claim 1, wherein the pinion and the shaft are formed from the metallic glass alloy, and the tooth part is formed from the crystalline metal.

5. The timepiece according to claim 1, wherein a portion of the shaft is formed from the metallic glass alloy, and the pinion, the tooth part, and other portions of the shaft are formed from the crystalline metal.

6. The timepiece according to claim 1, further comprising a coupling hole formed in the axial center of the tooth part, and a coupling part for fitting into and coupling with the coupling hole and formed on the external periphery of the shaft, wherein the entire internal peripheral surface and external peripheral surface of the coupling hole and the coupling part, having the same polygonal shape or oval shape, are in contact with each other.

7. The timepiece according to claim 1, wherein the metallic glass alloy is a metallic glass alloy whose composition has a Zr base, a Co base, a Fe base, or a Ni base.

* * * * *